US009167645B1

(12) United States Patent
Wu et al.

(10) Patent No.: US 9,167,645 B1
(45) Date of Patent: Oct. 20, 2015

(54) DRIVER CIRCUIT FOR IMPROVING LED FLICKERS

(71) Applicant: UNITY OPTO TECHNOLOGY CO., LTD., New Taipei (TW)

(72) Inventors: Chih-Hsien Wu, New Taipei (TW); Wei Chang, New Taipei (TW); Huan-Ying Lu, New Taipei (TW); Kai-Cheng Chuang, New Taipei (TW); Che-Hao Kuo, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 0 days.

(21) Appl. No.: 14/621,697

(22) Filed: Feb. 13, 2015

(30) Foreign Application Priority Data

Sep. 23, 2014 (TW) ..... 103216844 U

(51) Int. Cl.
*H05B 33/08* (2006.01)
*H05B 41/282* (2006.01)

(52) U.S. Cl.
CPC ..... *H05B 33/0815* (2013.01); *H05B 33/0851* (2013.01); *H05B 41/2828* (2013.01)

(58) Field of Classification Search
USPC ..... 315/274–279, 291, 307–312, 224, 185 S
See application file for complete search history.

(56) References Cited

U.S. PATENT DOCUMENTS 5,457,360 A * 10/1995 Notohamiprodjo et al. .. 315/219
8,836,236 B1 * 9/2014 Chiang et al. ..... 315/291
2012/0176057 A1 * 7/2012 Koutensky et al. ..... 315/210

* cited by examiner

*Primary Examiner* — Tuyet Vo
(74) *Attorney, Agent, or Firm* — Rosenberg, Klein & Lee

(57) ABSTRACT

A driver circuit adopting a primary side regulating architecture and an isolation transformer for improving LED flickers includes a transformer, a primary side regulating module, a feedback portion, a driving module and a dimming portion. The transformer includes an input coil, an auxiliary coil, a driving coil, and a dimming coil. The primary side regulating module is electrically coupled to the input coil; the feedback portion is electrically coupled to the auxiliary coil and the primary side regulating module; the driving module is electrically coupled to the driving coil; the dimming portion is electrically coupled to the dimming coil and the driving module. When a dimming signal inputted to the dimming portion has a voltage of 1V-10V, and the driver circuit is applied to a panel light, the LED flicker is improved effectively.

9 Claims, 9 Drawing Sheets

DRIVER CIRCUIT FOR IMPROVING LED FLICKERS

CROSS-REFERENCE TO RELATED APPLICATIONS

This non-provisional application claims priority under 35 U.S.C. §119(a) on Patent Application No(s). 103216844 filed in Taiwan, R.O.C. on Sep. 23, 2014, the entire contents of which are hereby incorporated by reference.

BACKGROUND OF THE INVENTION

1. Field of the Invention

The present invention relates to an LED driver circuit, and more particularly to a driver circuit with a primary side regulating architecture and a two-stage isolation transformer for improving LED flickers.

2. Description of the Related Art

In a conventional LED driver circuit, a single-stage flyback LED driver circuit architecture is generally adopted, wherein the voltage at an input terminal and the conversion of voltage by a transformer are provided for achieving the effect of driving an LED. When the power is turned on, electric energy is converted into magnetic energy stored in the transformer, and when the power is turned off, the magnetic energy in the transformer is converted into electric energy which is discharged to a secondary side, such that a buffer capacitor of the secondary side moderates the output voltage to drive the LED. However, the single-stage flyback LED driver circuit has a relatively too-high ripple voltage outputted from the secondary side, and the output current is not a constant current, so that the LED produces flickers. To improve and eliminate the flickers, it is necessary to increase the capacitance value of the buffer capacitor, and the increase of this numeric value reduces the power factor and increases the cost of the overall circuit.

In addition, the feedback of a secondary side optocoupler used as the method of the LED driver circuit is proposed, and the optocoupler has the effect of isolating the high pressure of the primary side and the low pressure of the secondary side, and generating and transmitting a feedback signal from the secondary side to the primary side to regulate the current, so as to achieve the effects of maintaining a constant current and improving the issue of LED flickers effectively. However, the method of using the feedback of the optocoupler as the LED driver circuit is relatively more complicated, and this method also requires a larger space of the circuit board and incurs a high component cost. The power factor is calculated by multiplying those of the primary side and the secondary side together, so that it is difficult to improve the overall efficiency of the circuit.

Therefore, the present invention provides a driver circuit for improving LED flickers, and the driver circuit is applied to a panel light, wherein the driver circuit uses a two-stage isolation transformer and a primary side regulating circuit, without requiring the use of the optocoupler for the feedback control or increasing the level of difficulty of the circuit, so as to achieve a better circuit efficiency and use less components. When a PWM dimming signal of 1V-10V is inputted, the issue of flickers of the LED driver circuit is improved effectively.

SUMMARY OF THE INVENTION

In view of the aforementioned problems of the prior art, it is a primary objective of the present invention to provide a driver circuit for improving LED flickers, wherein the driver circuit uses a two-stage isolation transformer and a primary side regulating circuit to improve the issue of flickers of the LED effectively, when a PWM dimming signal of 1V-10V is inputted.

To achieve the aforementioned objective, the present invention provides a driver circuit for improving LED flickers, with a primary side regulating architecture and an isolation transformer, comprising:

a transformer, having an input coil, an auxiliary coil, a driving coil, and a dimming coil, and the input coil being installed at a primary side of the transformer, and the auxiliary coil being installed at a side of the input coil and disposed on a primary side of the transformer, and the driving coil being installed at a secondary side of the transformer, and the dimming coil being installed at a side of the driving coil and disposed on a secondary side of the transformer, and the input coil and the driving coil being corresponsive to each other, and the auxiliary coil and the dimming coil being corresponsive to each other, and the transformer having an effect of isolating a primary side signal and a secondary side signal;

a primary side regulating module, electrically coupled to the input coil, for inputting an input voltage to the input coil;

a feedback portion, electrically coupled to the auxiliary coil and the primary side regulating module, for generating a feedback signal when the auxiliary coil receives an induction from the input coil, and transmitting the feedback signal to the primary side regulating module to maintain the input voltage constant;

a driving module, electrically coupled to the driving coil, and having a rear end electrically coupled to a plurality of LEDs, and the driving portion receiving a driving signal of the driving coil sensed by the input coil to drive the LEDs; and a dimming portion, with the dimming coil electrically coupled to the driving module, for inputting a dimming signal with a voltage falling within a range of 1V-10V, and outputting a regulating signal to the driving module; wherein when the input voltage is outputted to the input coil, the auxiliary coil senses the feedback signal from the input coil and transmits the feedback signal to the primary side regulating module to achieve the effect of maintaining the input voltage constant, and when the dimming signal is inputted to the dimming portion, and the dimming portion outputs the regulating signal to the driving module to produce a compensation, the LEDs are free of flickers.

In another embodiment, the primary side regulating module further comprises a power factor controller electrically coupled to a switch, and the switch being electrically coupled to an end of the input coil and controlled by the power factor controller to maintain the input voltage constant.

In another embodiment, the feedback portion further comprises a feedback capacitor, a first feedback resistor, and a second feedback resistor, and the first feedback resistor and the second feedback resistor are serially coupled to each other to form a feedback node, and the feedback capacitor, the first feedback resistor, and the second feedback resistor are parallely coupled to one another, and the feedback node is electrically coupled to the power factor controller, and the feedback signal is transmitted from the feedback node to the power factor controller.

In another embodiment, the driving module further comprises a driving controller serially coupled to a driving capacitor, and the driving capacitor is electrically coupled to the dimming portion.

In another embodiment, the dimming signal is a PWM dimming signal.

In another embodiment, the dimming portion further comprises a first dimming resistor, a second dimming resistor, a dimming capacitor, and the first dimming resistor and the second dimming resistor are serially coupled to each other, and the second dimming resistor and a dimming capacitor are parallely coupled to each other to form a dimming node, and the dimming node is electrically coupled to the driving capacitor, and when the PWM dimming signal is inputted to the dimming portion, the regulating signal is transmitted from the dimming node to the driving capacitor.

The driver circuit for improving LED flickers in accordance with the present invention uses a two-stage isolation transformer and a primary side regulating circuit to improve the issue of flickers of an LED effectively provided that the PWM dimming signal has a voltage of 1V-10V and skip the architecture of using an optocoupler for feedback control to simply the complexity of the circuit, so as to achieve a better circuit efficiency.

DETAILED DESCRIPTION OF THE PREFERRED EMBODIMENTS

Figure 1:
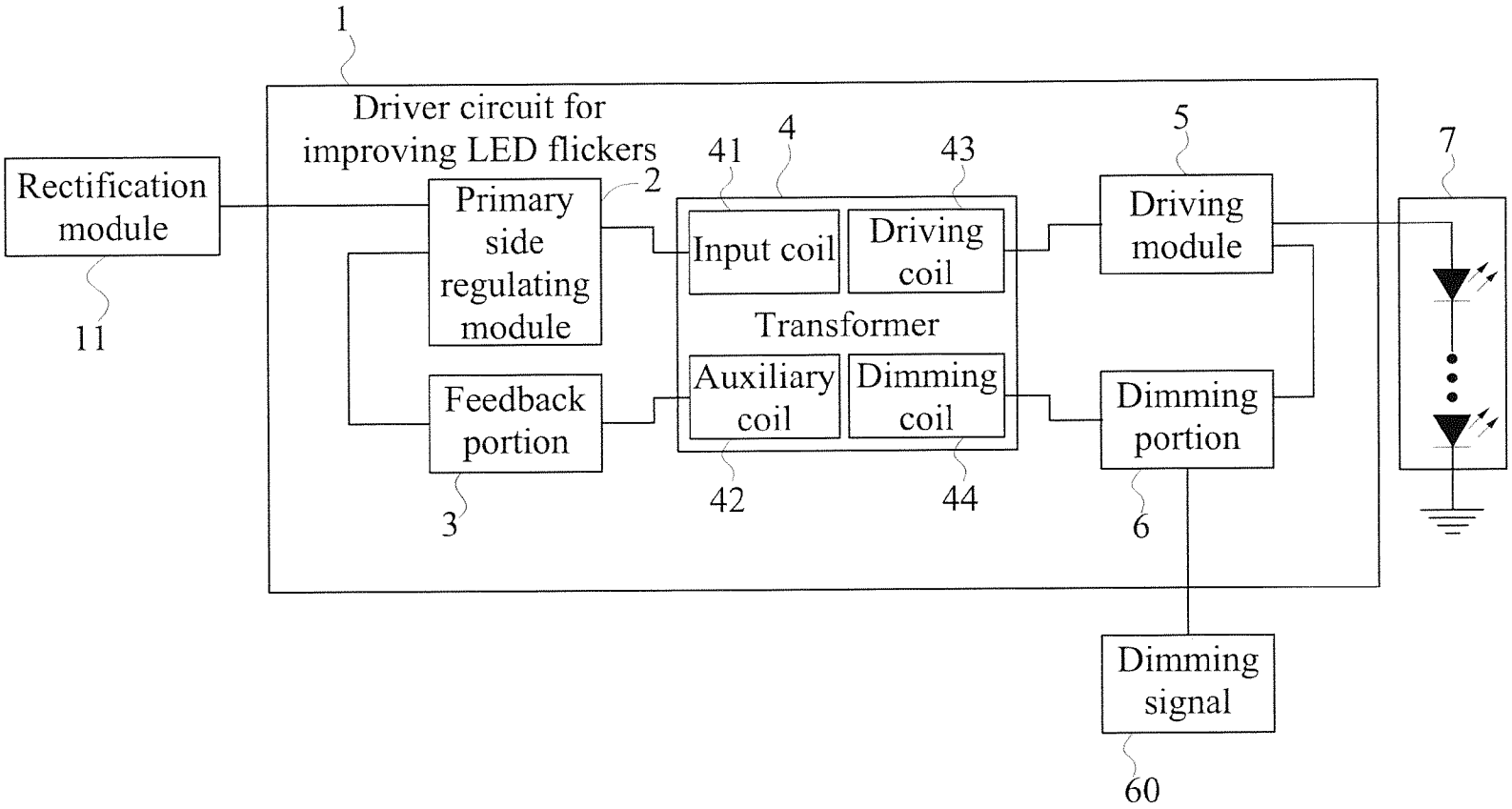
FIG. 1 is a schematic block diagram of the present invention.

The aforementioned and other objectives, technical characteristics and advantages of the present invention will become apparent with the detailed description of preferred embodiments and the illustration of related drawings as follows.

With reference to FIGS. 1, 3B, 3C, 3D, and 3E for a schematic block diagram of the present invention, a circuit diagram of a primary side regulating module, a circuit diagram of a transformer and a feedback portion, a circuit diagram of a dimming portion, and a circuit diagram of a driving portion of the present invention respectively, a driver circuit of the present invention uses a primary side regulating architecture and an isolation transformer to improve LED flickers 1. The driver circuit comprises: a transformer 4 including an input coil 41, an auxiliary coil 42, a driving coil 43, a dimming coil 44, wherein the input coil 41 is installed at a primary side of the transformer 4, and the auxiliary coil 42 is installed on a side of the input coil 41 and disposed at the primary side of the transformer 4, and the driving coil 43 is installed at a secondary side of the transformer 4, and the dimming coil 44 is installed on a side of the driving coil 43 and disposed at the secondary side of the transformer 4, and the input coil 41 is corresponsive to the driving coil 43, and the auxiliary coil 42 and the dimming coil 44 are corresponsive to each other, and the transformer 4 has an effect of isolating a primary side signal and a secondary side signal; a primary side regulating module 2, electrically coupled to the input coil 41, provided for inputting an input voltage to the input coil 41; a feedback portion 3, electrically coupled to the auxiliary coil 42 and the primary side regulating module 2, and provided for receiving a feedback signal generated by the auxiliary coil 42 and sensed by the input coil 41 and transmitting the feedback signal to the primary side regulating module 2 to maintain the input voltage constant; a driving module 5, electrically coupled to the driving coil 43, and having a rear end electrically coupled to a plurality of LEDs 7, and provided for receiving a driving signal of the driving coil 43 sensed by the input coil 41 to drive the LEDs 7; and a dimming portion 6, electrically coupled to the dimming coil 44 and the driving module 5, for inputting a dimming signal of 1V-10V by the dimming portion 6 and outputting a regulating signal to the driving module 5; such that when a rectification module 11 outputs a rectify signal to the primary side regulating module 2 and generates the input voltage, and the input voltage is inputted to the input coil 41, the auxiliary coil 42 senses the feedback signal from the input coil 41 and transmits the feedback signal to the primary side regulating module 2 to achieve the effect of maintaining the input voltage constant, and when a dimming signal is inputted to the dimming portion 6, and the dimming portion 6 outputs the regulating signal to the driving module 5 to produce a compensation, a flicker-free effect of the LEDs 7 is achieved.

Figure 3A:
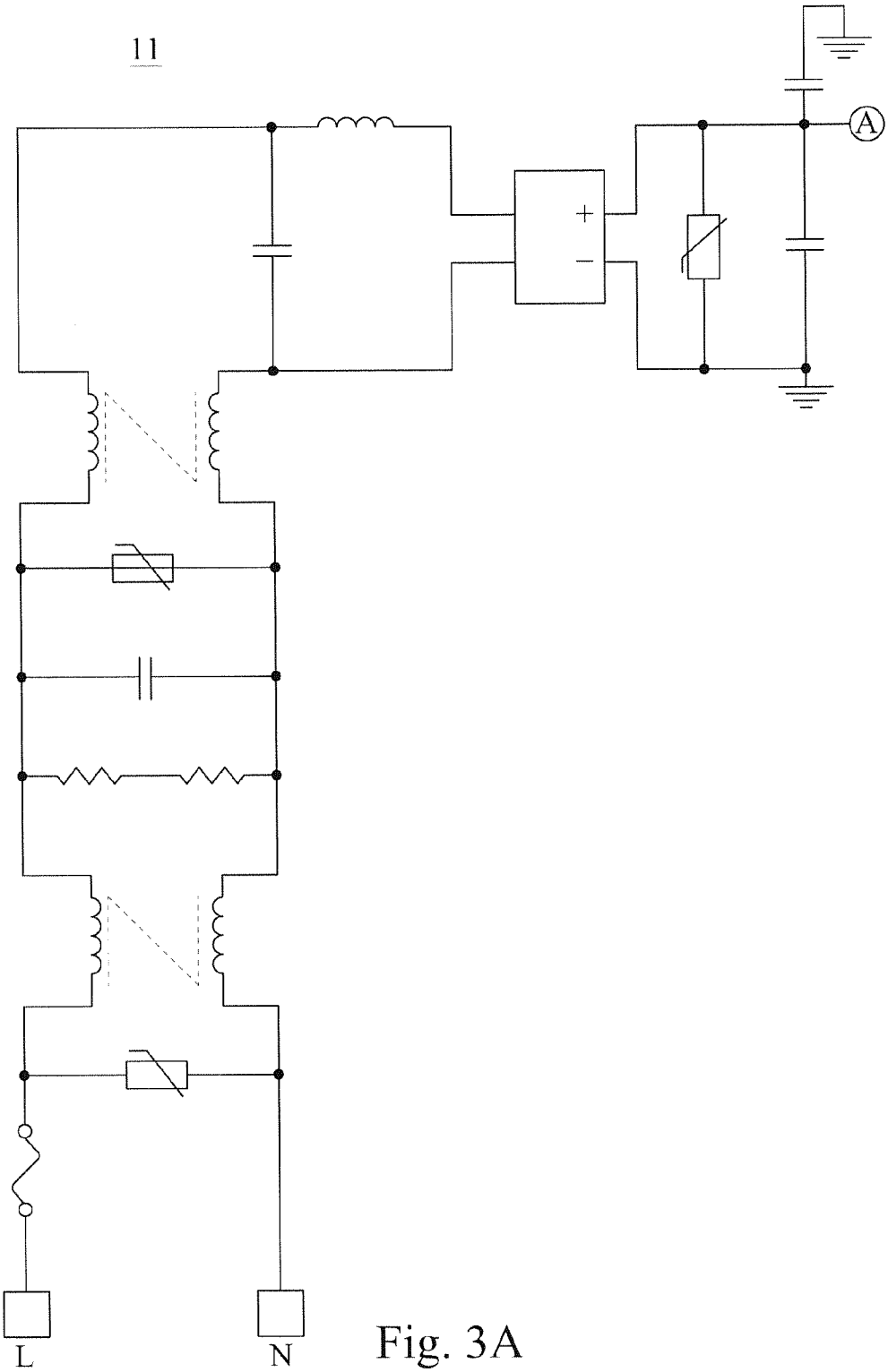
FIG. 3A is a circuit diagram of a rectification module of the present invention.
Figure 3B:
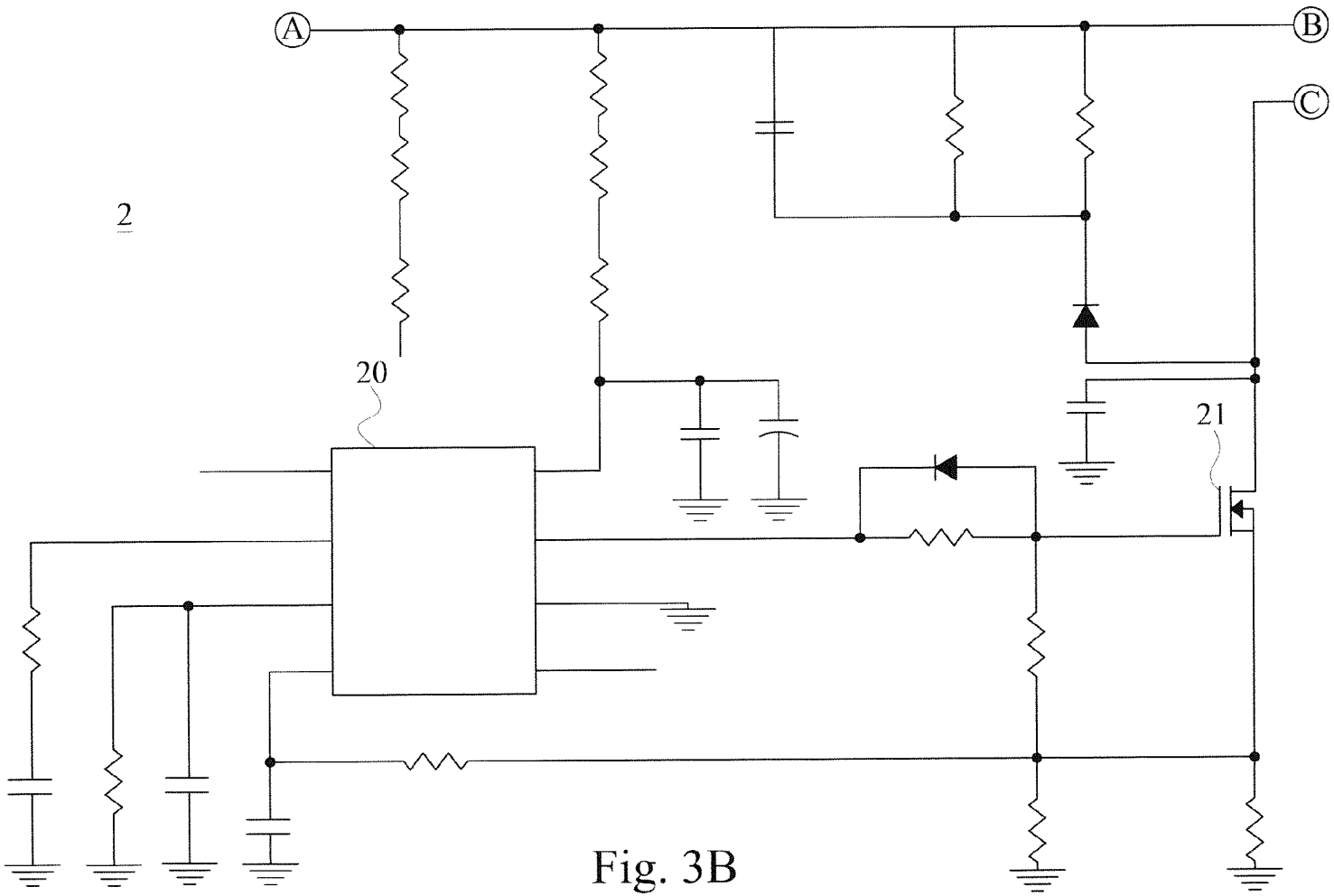
FIG. 3B is a circuit diagram of a primary side regulating module of the present invention.
Figure 3C:
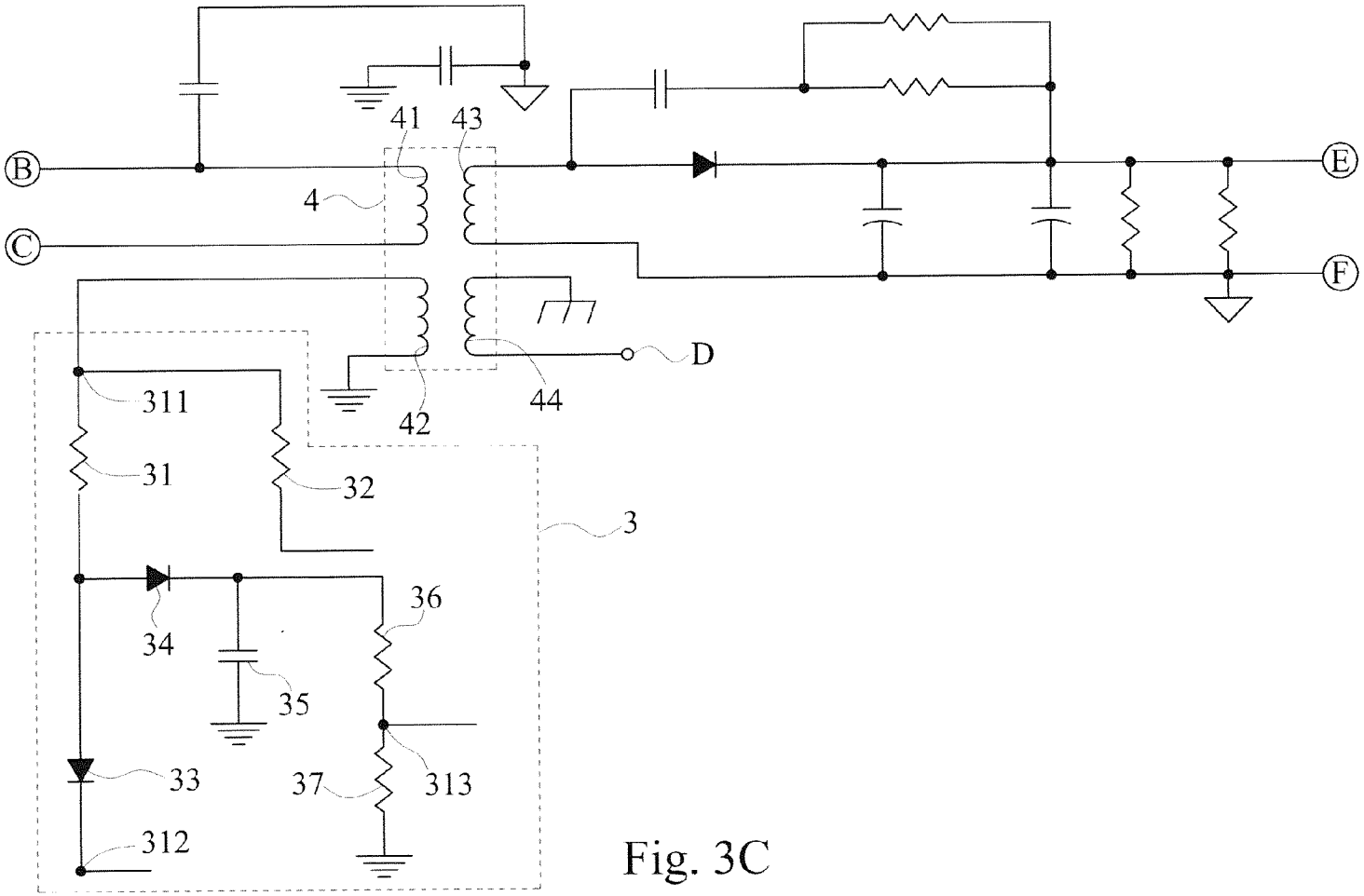
FIG. 3C is a circuit diagram of a transformer and a feedback portion of the present invention.

With reference to FIGS. 3B and 3C for a circuit diagram of a primary side regulating module and a circuit diagram of a transformer and a feedback portion in accordance with another preferred embodiment of the present invention respectively, the primary side regulating module 2 further comprises a power factor controller 20 electrically coupled to a switch 21, and the switch 21 is electrically coupled to an end of the input coil 41, and the power factor controller 20 is provided for controlling the switch 21 to maintain the input voltage constant.

Figure 2:
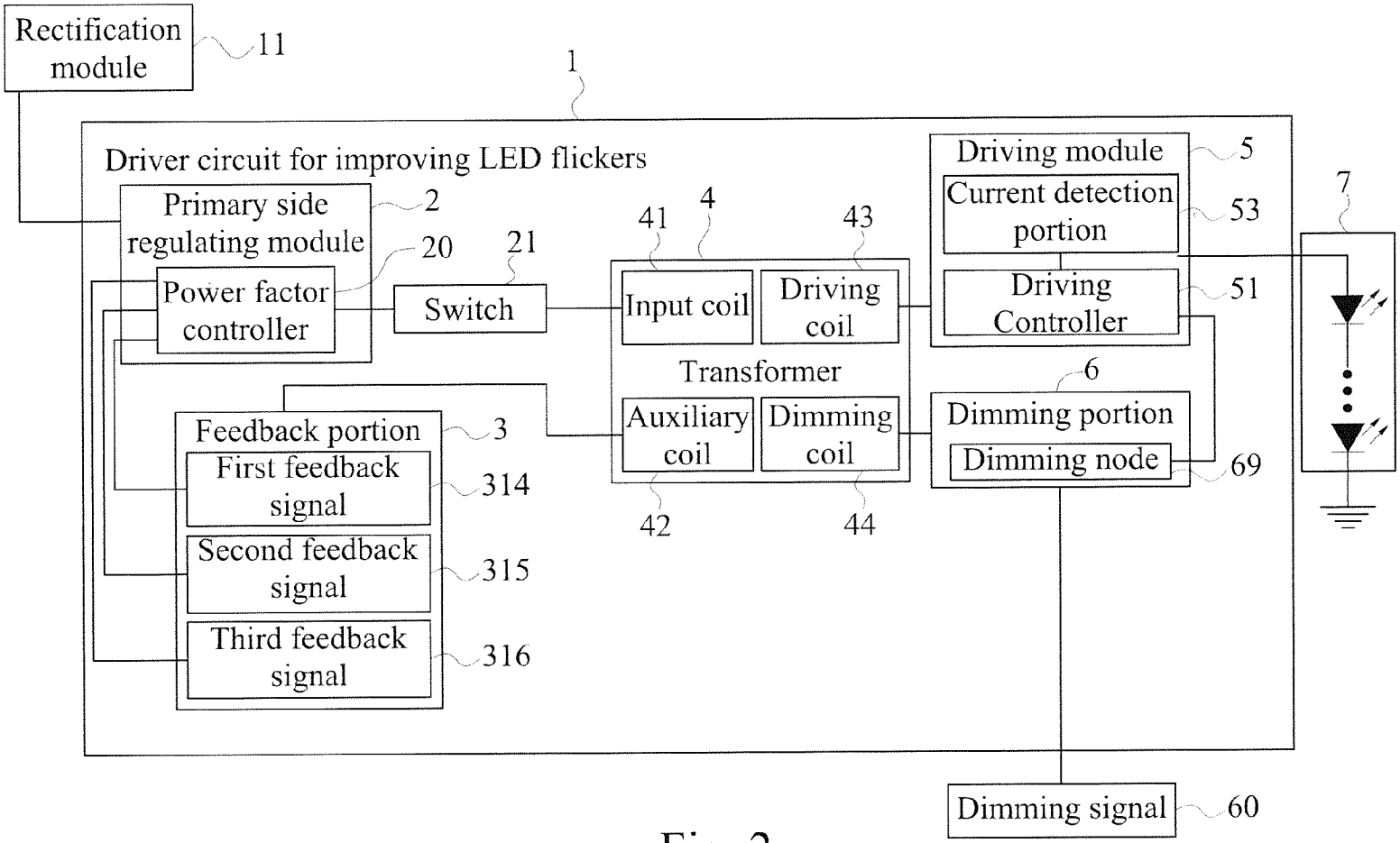
FIG. 2 is a schematic block diagram of a preferred embodiment of the present invention.

With reference to FIG. 2 for a schematic block diagram in accordance to another preferred embodiment of the present invention, the feedback signal further comprises a first feedback signal 314, a second feedback signal 315, and a third feedback signal 316.

With reference to FIGS. 2, 3B and 3C for a schematic block diagram of a preferred embodiment of the present invention, a circuit diagram of a primary side regulating module, and a circuit diagram of a feedback portion in accordance with another preferred embodiment of the present invention respectively, the feedback portion 3 further comprises a first voltage dividing resistor 31, a second voltage dividing resistor 32, a feedback capacitor 35, a first feedback resistor 36, a second feedback resistor 37, a first diode 33, and a second diode 34, wherein an end of the first voltage dividing resistor 31 and the auxiliary coil 42 are serially coupled to each other to form a first node 311, and the first node 311 and an end of the second voltage dividing resistor 32 are serially coupled to each other, and the other end of the second voltage dividing resistor 32 and the power factor controller 20 are electrically coupled to each other to transmit the first feedback signal 314 for controlling the switch 21, and the other end of the first voltage dividing resistor 31 is serially coupled to the first diode 33 and the second diode 34, wherein the other end of the first diode 33 is a second node 312, and the second node 312 and the power factor controller 20 are electrically coupled to each other for transmitting the second feedback signal 315 to the power factor controller 20 to supply a working voltage of the power factor controller 20, and the second diode 34 is serially coupled to the feedback capacitor 35 and the first feedback resistor 36, and an end of the first feedback resistor 36 and the second feedback resistor 37 are serially coupled to each other to form a third node 313, and the third node 313 is electrically coupled to the power factor controller 20 for transmitting the third feedback signal 316 to maintain the input voltage constant.

Figure 3D:
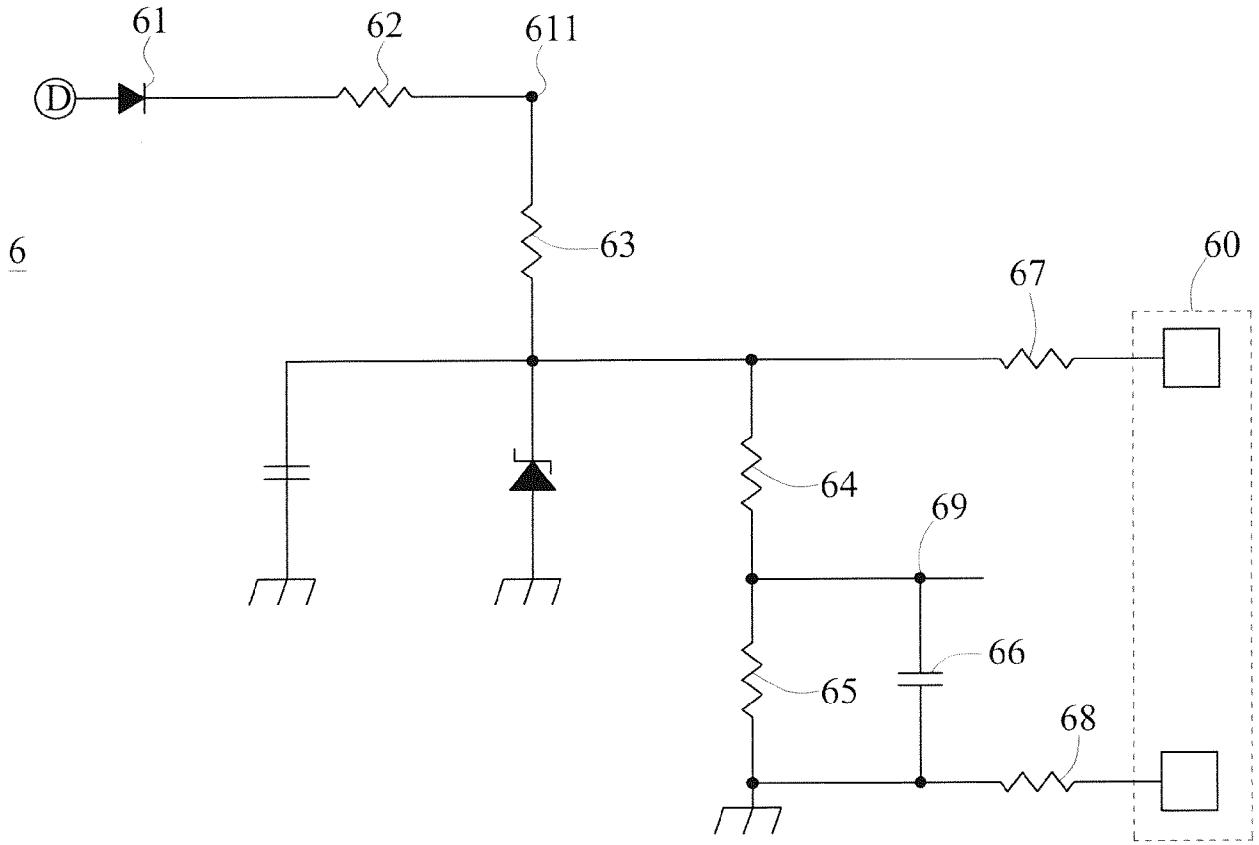
FIG. 3D is a circuit diagram of a dimming portion of the present invention.
Figure 3E:
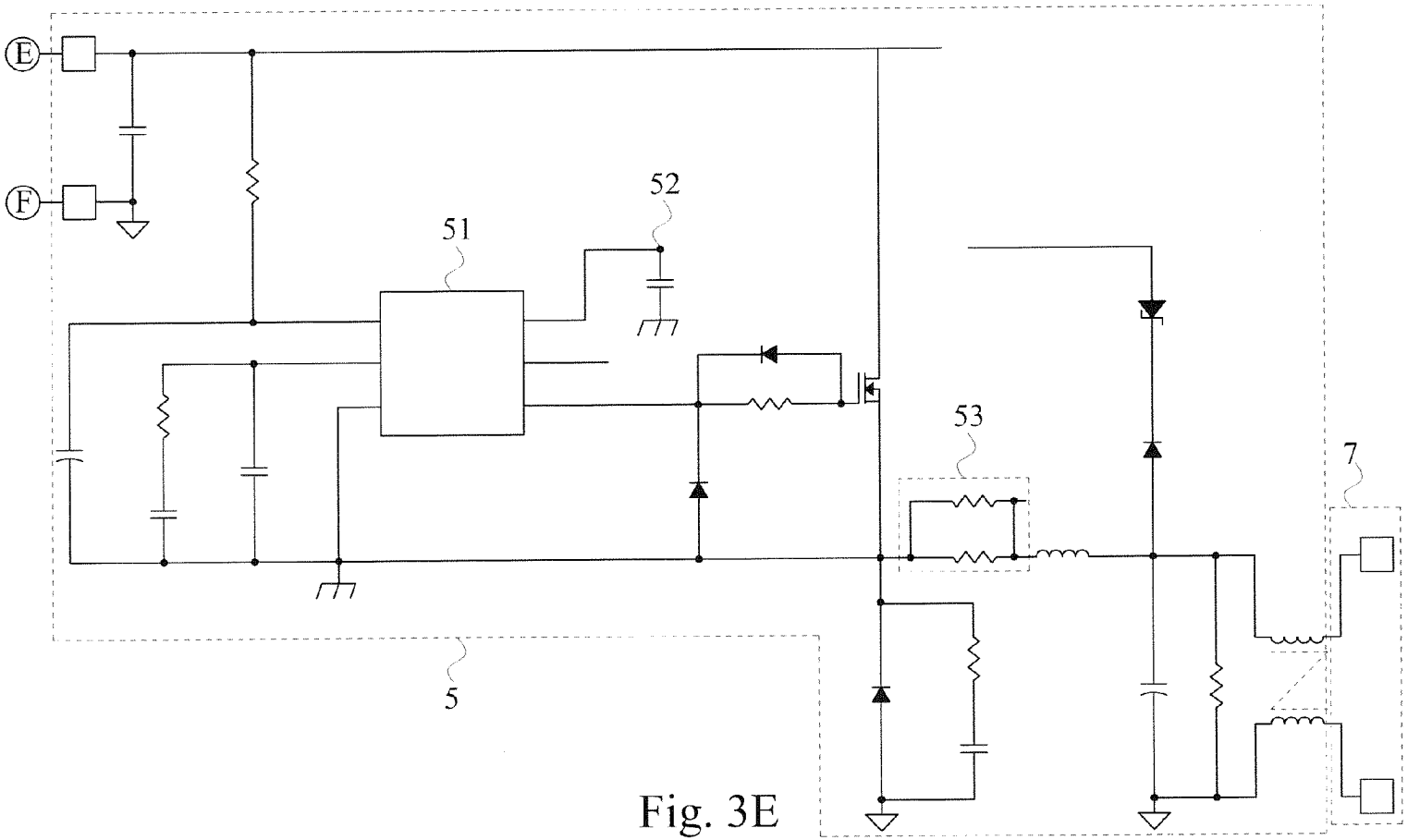
FIG. 3E is a circuit diagram of a driving portion of the present invention.

With reference to FIGS. 3D and 3E fora circuit diagram of a dimming portion and a circuit diagram of a driving portion in accordance with another preferred embodiment of the present invention respectively, the driving module 5 further comprises a driving controller 51 and a current detection portion 53, and the driving controller 51 is serially coupled to a driving capacitor 52, and the driving capacitor 52 is electrically coupled to the dimming portion 6. The current detection portion 53 is electrically coupled to the driving controller 51 and the LEDs 7, and the current detection portion 53 is provided for detecting whether or not the current and voltage outputted from the driving controller 51 to the LEDs 7 are constant.

With reference to FIG. 3D for a circuit diagram of a dimming portion in accordance to another preferred embodiment of the present invention, the dimming signal is a PWM dimming signal 60.

With reference to FIGS. 3C, 3D and 3E for a circuit diagram of a transformer and a feedback portion, a circuit diagram of a dimming portion, and a circuit diagram of a driving portion in accordance with another preferred embodiment of the present invention respectively, the dimming portion 6 further comprises a forward diode 61, a first forward resistor 62, a second forward resistor 63, a first dimming resistor 64, a second dimming resistor 65, a dimming capacitor 66, a first current limiting resistor 67, and a second current limiting resistor 68, wherein the forward diode 61 is electrically coupled to the dimming coil 44, and the other end of the forward diode 61 is electrically coupled to the first forward resistor 62, and the other end of the first forward resistor 62 is serially coupled to the second forward resistor 63 to form a fourth node 611, and the fourth node 611 is electrically coupled to the driving controller 51, and the other end of the second forward resistor 63 is electrically coupled to the first dimming resistor 64, and the first dimming resistor 64 is serially coupled to the second dimming resistor 65, and the second dimming resistor 65 is parallely coupled to a dimming capacitor 66 to form a dimming node 69, and the first current limiting resistor 67 is serially coupled to the first dimming resistor 64, and the second current limiting resistor 68 is electrically coupled to the dimming capacitor 66, and the dimming node 69 is electrically coupled to the driving capacitor 52. When the PWM dimming signal 60 is inputted from the first current limiting resistor 67 and the second current limiting resistor 68, the regulating signal is transmitted from the dimming node 69 to the driving capacitor 52. When the PWM dimming signal 60 having a voltage varies within a range of 1V-10V, the regulating signal is transmitted from the dimming node 69 to the driving capacitor 52, so that the driving controller 51 performs a compensation to maintain the output current constant.

Figure 4:
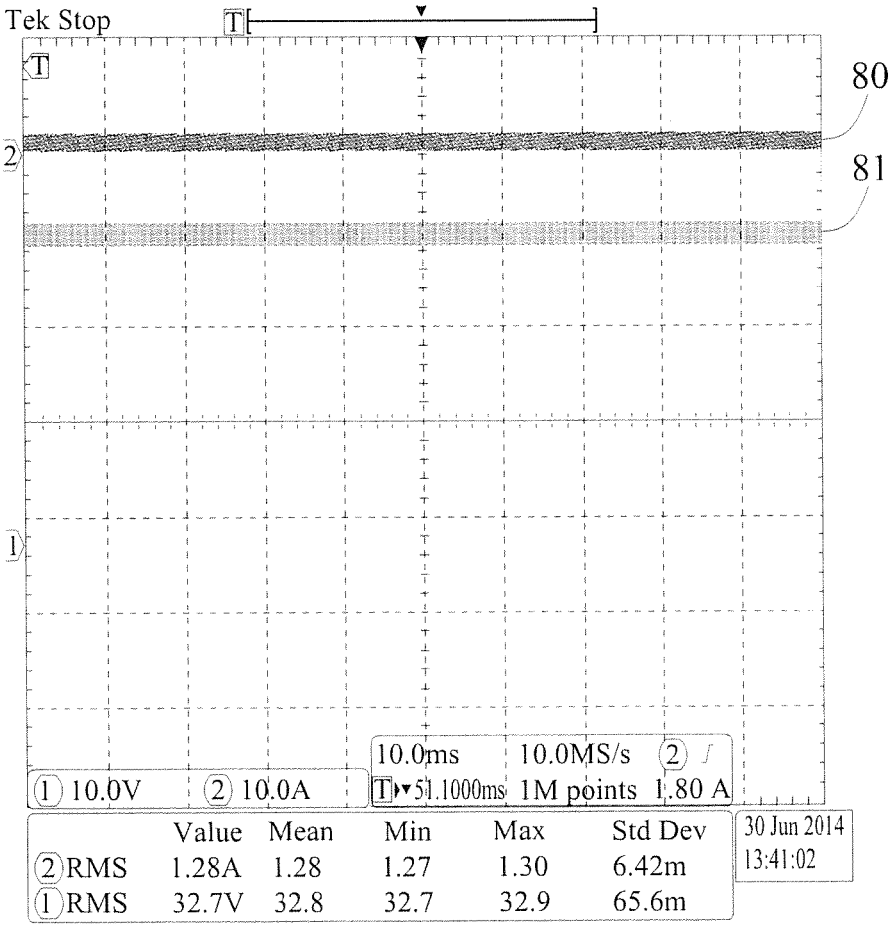
FIG. 4 is a waveform diagram of the output voltage and current at an LED end with the input voltage of 120V in accordance with the present invention.
Figure 5:
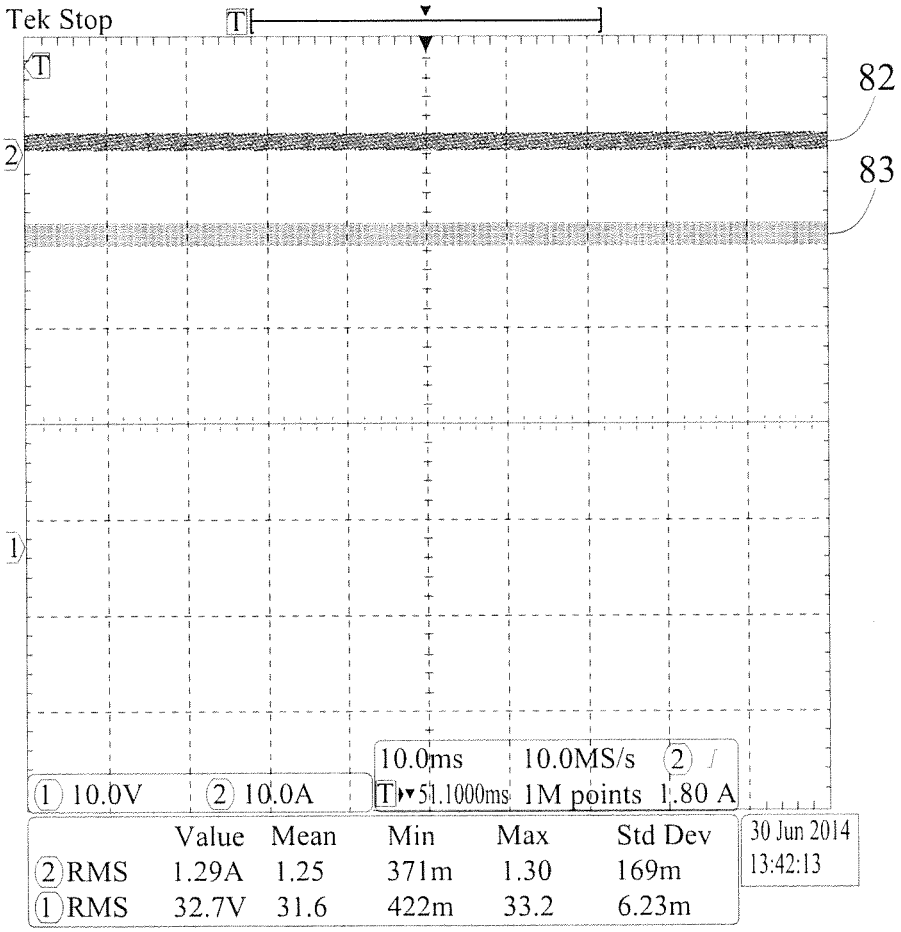
FIG. 5 is a waveform diagram of the output voltage and current at an LED end with the input voltage of 230V in accordance with the present invention.

With reference to FIGS. 4 and 5 for a waveform diagram of the output voltage and current at an LED end having an input voltage of 120V and a waveform diagram of the output voltage and current at an LED end having an input voltage of 230V in accordance with the present invention respectively, an output signal of a physical circuit of the present invention shows that the output current 80 at an LED end having an input voltage of 120V, the output voltage 81 at an LED end having an input voltage of 120V, the output current 82 at an LED end having an input voltage of 230V, the output voltage 83 at an LED end having an input voltage of 230V, and the voltage and current outputted from the driving module 5 to the LEDs 7 are all constant. Therefore, the LEDs 7 do not have any issue of flickers. With reference to Table 1 for an analysis of the performance of a driver circuit for improving LED flickers, if the inputted rectified voltage falls within a range of 90V-277V, the current measured at an LED end will fall within a range of 1.3 amperes −1.29 amperes, and the peak current will fall within a range of 1.39 amperes −1.42 amperes, and the voltage will fall within a range of 32.8V-33.3V, and the efficiency will fall within a range of 85.9%-87.2%. In the driver circuit for improving LED flickers in accordance with the present invention, if the PWM dimming signal has a voltage falling within a range mf 1V-10V and the inputted rectified voltage falls within a range of 90V-277V, the LED flickers can be improved effectively. In addition, the present invention skips the use of an optocoupler as the architecture of the feedback control to simplify the complexity of the circuit, and achieves a better circuit efficiency.

TABLE 1

Performance Analysis of a Driver Circuit for Improving LED Flickers

| Vac(V) | Freq(Hz) | AC Iin(mA) | PF | Pin(W) | Current (mA) | Maximum Current max(mA) | Multiple | Vout rms (V) | LED (W) | Efficiency (%) |
|---|---|---|---|---|---|---|---|---|---|---|
| 90 | 60 | 561 | 0.995 | 50.4 | 1300 | 1420 | 1.092 | 33.3 | 43.29 | 85.9% |
| 100 | 60 | 501 | 0.994 | 50 | 1300 | 1420 | 1.092 | 33.3 | 43.29 | 86.6% |
| 110 | 60 | 452 | 0.993 | 49.5 | 1300 | 1410 | 1.085 | 33.2 | 43.16 | 87.2% |
| 120 | 60 | 412 | 0.993 | 49.3 | 1300 | 1420 | 1.092 | 33.2 | 43.16 | 87.5% |
| 130 | 60 | 378 | 0.993 | 49.1 | 1300 | 1410 | 1.085 | 33.1 | 43.03 | 87.6% |
| 140 | 60 | 351 | 0.991 | 49 | 1300 | 1410 | 1.085 | 33.1 | 43.03 | 87.8% |
| 150 | 60 | 327 | 0.99 | 48.8 | 1290 | 1390 | 1.078 | 33 | 42.57 | 87.2% |
| 160 | 60 | 307 | 0.988 | 48.7 | 1290 | 1390 | 1.078 | 33 | 42.57 | 87.4% |
| 170 | 60 | 289 | 0.95 | 48.7 | 1290 | 1390 | 1.078 | 33 | 42.57 | 87.4% |
| 180 | 60 | 273 | 0.983 | 48.7 | 1290 | 1390 | 1.078 | 32.9 | 42.441 | 87.1% |
| 190 | 60 | 260 | 0.98 | 48.7 | 1290 | 1390 | 1.078 | 32.9 | 42.441 | 87.1% |
| 200 | 50 | 249 | 0.976 | 48.7 | 1290 | 1390 | 1.078 | 33 | 42.57 | 87.4% |
| 210 | 50 | 238 | 0.972 | 48.7 | 1290 | 1390 | 1.078 | 33.1 | 42.699 | 87.7% |
| 220 | 50 | 227 | 0.973 | 48.6 | 1290 | 1390 | 1.078 | 33 | 42.57 | 87.6% |
| 230 | 50 | 217 | 0.97 | 48.6 | 1290 | 1390 | 1.078 | 32.9 | 42.441 | 87.3% |
| 240 | 50 | 209 | 0.966 | 48.6 | 1290 | 1390 | 1.078 | 32.9 | 42.441 | 87.3% |
| 250 | 50 | 202 | 0.963 | 48.6 | 1290 | 1390 | 1.078 | 32.9 | 42.441 | 87.3% |

TABLE 1-continued

Performance Analysis of a Driver Circuit for Improving LED Flickers

| Vac(V) | Freq(Hz) | AC Iin(mA) | PF | Pin(W) | Current (mA) | Maximum Current max(mA) | Multiple | Vout rms (V) | LED (W) | Efficiency (%) |
|---|---|---|---|---|---|---|---|---|---|---|
| 264 | 50 | 192 | 0.956 | 48.5 | 1290 | 1390 | 1.078 | 32.8 | 42.312 | 87.2% |
| 277 | 50 | 185 | 0.949 | 48.5 | 1290 | 1390 | 1.078 | 32.8 | 42.312 | 87.2% |

What is claimed is:

1. A driver circuit for improving LED flickers, with a primary side regulating architecture and an isolation transformer, comprising:

a transformer, having an input coil, an auxiliary coil, a driving coil, and a dimming coil, and the input coil being installed at a primary side of the transformer, and the auxiliary coil being installed at a side of the input coil and disposed on a primary side of the transformer, and the driving coil being installed at a secondary side of the transformer, and the dimming coil being installed at a side of the driving coil and disposed on a secondary side of the transformer, and the input coil and the driving coil being corresponsive to each other, and the auxiliary coil and the dimming coil being corresponsive to each other, and the transformer having an effect of isolating a primary side signal and a secondary side signal;

a primary side regulating module, electrically coupled to the input coil, for inputting an input voltage to the input coil;

a feedback portion, electrically coupled to the auxiliary coil and the primary side regulating module, for generating a feedback signal when the auxiliary coil receives an induction from the input coil, and transmitting the feedback signal to the primary side regulating module to maintain the input voltage constant;

a driving module, electrically coupled to the driving coil, and having a rear end electrically coupled to a plurality of LEDs, and the driving portion receiving a driving signal of the driving coil sensed by the input coil to drive the LEDs; and a dimming portion, with the dimming coil electrically coupled to the driving module, for inputting a dimming signal with a voltage falling within a range of 1V-10V, and outputting a regulating signal to the driving module; wherein when the input voltage is outputted to the input coil, the auxiliary coil senses the feedback signal from the input coil and transmits the feedback signal to the primary side regulating module to achieve the effect of maintaining the input voltage constant, and when the dimming signal is inputted to the dimming portion, and the dimming portion outputs the regulating signal to the driving module to produce a compensation, the LEDs are free of flickers.

2. The driver circuit for improving LED flickers according to claim 1, wherein the feedback portion further comprises a feedback capacitor, a first feedback resistor, and a second feedback resistor, and the first feedback resistor and the second feedback resistor being serially coupled to each other to form a feedback node, and the feedback capacitor, the first feedback resistor and the second feedback resistor being coupled to one another in parallel, and the feedback node being electrically coupled to the power factor controller, and the feedback signal being transmitted from the feedback node to the power factor controller.

3. The driver circuit for improving LED flickers according to claim 1, wherein the dimming signal is a PWM dimming signal.

4. The driver circuit for improving LED flickers according to claim 1, wherein the dimming portion further comprises a first dimming resistor, a second dimming resistor, and a dimming capacitor, and the first dimming resistor and the second dimming resistor are serially coupled to each other, and the second dimming resistor and a dimming capacitor are parallely coupled to each other to form a dimming node, and the dimming node is electrically coupled to the driving capacitor, and when the PWM dimming signal is inputted to the dimming portion, the regulating signal is transmitted from the dimming node to the driving capacitor.

5. The driver circuit for improving LED flickers according to claim 1, wherein the driving module further comprising a driving controller serially coupled to a driving capacitor, and the driving capacitor being electrically coupled to the dimming portion.

6. The driver circuit for improving LED flickers according to claim 5, wherein the dimming portion further comprises a first dimming resistor, a second dimming resistor, and a dimming capacitor, and the first dimming resistor and the second dimming resistor are serially coupled to each other, and the second dimming resistor and a dimming capacitor are coupled to each other in parallel to form a dimming node, and the dimming node is electrically coupled to the driving capacitor, and when the PWM dimming signal is inputted to the dimming portion, the regulating signal is transmitted from the dimming node to the driving capacitor.

7. The driver circuit for improving LED flickers according to claim 1, wherein the primary side regulating module further comprises a power factor controller electrically coupled to a switch, and the switch being electrically coupled to an end of the input coil and controlled by the power factor controller to maintain the input voltage constant.

8. The driver circuit for improving LED flickers according to claim 7, wherein the feedback portion further comprises a feedback capacitor, a first feedback resistor, and a second feedback resistor, and the first feedback resistor and the second feedback resistor being serially coupled to each other to form a feedback node, and the feedback capacitor, the first feedback resistor, and the second feedback resistor being coupled to one another in parallel, and the feedback node being electrically coupled to the power factor controller, and the feedback signal being transmitted from the feedback node to the power factor controller.

9. The driver circuit for improving LED flickers according to claim 8, wherein the dimming portion further comprises a first dimming resistor, a second dimming resistor, and a dimming capacitor, and the first dimming resistor and the second dimming resistor are serially coupled to each other, and the second dimming resistor and a dimming capacitor are coupled to each other in parallel to form a dimming node, and the dimming node is electrically coupled to the driving capacitor, and when the PWM dimming signal is inputted to the dimming portion, the regulating signal is transmitted from the dimming node to the driving capacitor.

* * * * *